US007484995B2

(12) United States Patent
Ding

(10) Patent No.: US 7,484,995 B2
(45) Date of Patent: Feb. 3, 2009

(54) LAMP SYSTEM

(75) Inventor: Feng Ding, Guang Dong (CN)

(73) Assignee: Hui Dong Xie Qun LIghting Manufacturing, Hui Dong, Guang Dong Province (CN)

( * ) Notice: Subject to any disclaimer, the term of this patent is extended or adjusted under 35 U.S.C. 154(b) by 0 days.

(21) Appl. No.: 11/760,797

(22) Filed: Jun. 11, 2007

(65) Prior Publication Data

US 2008/0303446 A1 Dec. 11, 2008

(51) Int. Cl.
*H01R 31/08* (2006.01)

(52) U.S. Cl. ..... 439/513; 439/188; 439/699.2; 362/652

(58) Field of Classification Search ..... 439/188, 439/513, 619, 699.2; 200/51.1, 51.12; 362/226, 362/288, 652, 653, 654, 657, 806
See application file for complete search history.

(56) References Cited

U.S. PATENT DOCUMENTS 5,139,343 A 8/1992 Lin
5,453,664 A 9/1995 Harris
6,257,740 B1 7/2001 Gibboney, Jr.
6,580,182 B2 6/2003 Janning
6,642,660 B1 11/2003 Shieh
6,650,065 B1 11/2003 Shieh
6,805,463 B2 10/2004 Shieh
7,264,392 B2 * 9/2007 Massabki et al. ..... 362/652
7,381,070 B2 * 6/2008 Foo ..... 439/188
2006/0274556 A1 12/2006 Massabki et al.

* cited by examiner

*Primary Examiner*—James Harvey
(74) *Attorney, Agent, or Firm*—Jianq Chyun IP Office

(57) ABSTRACT

A lamp system including a bulb assembly, a socket assembly, and a conductor base assembly is provided. The bulb assembly includes an insulation object, a first bulb pin, and a second bulb pin. The socket assembly includes an outer housing, a first conductive terminal, and a second conductive terminal. The outer housing includes an opening to install the bulb assembly. The conductor base assembly includes a conductor. The conductor base assembly is an element manufactured independently and should be placed within the socket assembly. When the bulb assembly is not installed in the socket assembly, the two ends of the conductor contact the conductive terminals, respectively. When the bulb assembly is installed in the socket assembly, the insulation object on the bottom of the bulb assembly insulates the terminals from the conductor. The conductive terminals contact the bulb pins, respectively.

10 Claims, 6 Drawing Sheets

LAMP SYSTEM

BACKGROUND OF THE INVENTION

1. Field of the Invention

The present invention relates to a lamp system, and more particularly to a lamp system applicable to a series-connected light source.

2. Description of Related Art

A series-connected light source formed of conventional lamp systems often cannot form a conducting path due to one damaged lamp system. Therefore, a lot of inventors have manufactured a lamp system having a loop which is always in a conducting state. If one bulb assembly of a lamp system is damaged, the whole series-connected light may still form a conducting path when the damaged bulb assembly is removed or even when the damaged bulb assembly is not removed.

Referring to FIG. 1, a lamp system disclosed in U.S. Pat. No. 6,257,740 is shown. The lamp system 10 includes a bulb assembly 100 and a socket assembly 104. The bulb assembly 10 includes a first bulb pin 101, a second bulb pin 102, and an insulator 103 disposed on the bottom thereof. The socket assembly 104 includes an outer housing 105, a first elastic conductive terminal 106, and a second elastic conductive terminal 107. The outer housing 105 includes an opening 105A to install the bulb assembly. The outer housing 105 further includes a first wire opening 106A and a second wire opening 107A, so as to connect the elastic conductive terminals 106, 107 with external wires 108, 109. The first elastic conductive terminal 106 is externally connected to a first wire 108, and the second elastic conductive terminal 107 is externally connected to a second wire 109. When the bulb assembly 100 is not installed to the socket assembly 104, the first elastic conductive terminal 106 and the second elastic conductive terminal 107 contact with each other, such that a conducting path is formed between the first elastic conductive terminal 106 and the second elastic conductive terminal 107.

Referring to FIG. 2, a schematic view of installing the bulb assembly 100 in FIG. 1 to the socket assembly 104 is shown. When the bulb assembly 100 is installed on the socket assembly 104, the insulator 103 insulates the first elastic conductive terminal 106 from the second elastic conductive terminal 107, such that the first elastic conductive terminal 106 and the second elastic conductive terminal 107 do not contact with each other. At this time, the first bulb pin 101 contacts the first elastic conductive terminal 106, and the second bulb pin 102 contacts the second elastic conductive terminal 107. The bulb assembly 100 forms a conducting path with the first elastic conductive terminal 106 and the second elastic conductive terminal 107.

More than one lamp system 10 may be connected in series to form a series-connected light source. If one bulb assembly 100 in any lamp system 10 in the series-connected light source is damaged, the whole series-connected light source may still form a conducting path as long as the damaged bulb assembly 100 is removed from the socket assembly 104. However, if the bulb assembly 100 in the lamp system 10 has been installed on the socket assembly 104 for a long time, the elastic conductive terminals 106 and 107 will suffer elastic fatigue. Therefore, when the elastic conductive terminals 106 and 107 suffer the elastic fatigue, it is possible that the first elastic conductive terminal 106 and the second elastic conductive terminal 107 cannot contact with each other due to the elastic fatigue after the bulb assembly 100 is removed. If the bulb assembly 100 of the lamp system 10 suffering the elastic fatigue is damaged, it is still possible that the whole series-connected light source cannot form a conducting path even if the bulb assembly 100 is removed from the socket assembly 104.

Referring to FIG. 3, a lamp system disclosed in U.S. Pat. No. 6,805,463 is shown. The lamp system 20 includes a bulb assembly 200, a socket assembly 204, and a shunt sheet metal socket assembly 210. The bulb assembly 20 includes a first bulb pin 201, a second bulb pin 202, and an insulator 203 disposed on the bottom thereof. The socket assembly 204 includes an outer housing 205, a first conductive terminal 206, and a second conductive terminal 207. The outer housing 205 includes an opening 205A to install the bulb assembly 200. The outer housing 205 further includes a first wire opening 206A and a second wire opening 207A, so as to connect the conductive terminals 206, 207 with external wires 208, 209. The first conductive terminal 206 is externally connected to the first wire 208, and the second conductive terminal 207 is externally connected to the second wire 209. The shunt sheet metal socket assembly 210 includes a shunt sheet metal 211. The shunt sheet metal socket assembly 210 is disposed in the socket assembly 204. The shunt sheet metal socket assembly 210 is pushed by an external force, and is restored to the original position when the external force is removed. When the bulb assembly 200 is not installed on the socket assembly 204, the first conductive terminal 206 and the second conductive terminal 207 contact the two ends of the shunt sheet metal 211, respectively, such that a conducting path is formed between the first conductive terminal 206, the second conductive terminal 207, and the shunt sheet metal 211.

Referring to FIG. 4, a schematic view of installing the bulb assembly 200 in FIG. 3 on the socket assembly 204 is shown. When the bulb assembly 200 is installed on the socket assembly 204, the insulator 203 contacts the shunt sheet metal 211. The bulb assembly 200 pushes the shunt sheet metal socket assembly 210 downward, and the first conductive terminal 206 and the second conductive terminal 207 are insulated from the shunt sheet metal 211. That is, the first conductive terminal 206 and the second conductive terminal 207 will not contact the two ends of the shunt sheet metal 211. At this time, the first bulb pin 201 contacts the first conductive terminal 206, and the second bulb pin 202 contacts the second conductive terminal 207. The bulb assembly 200 forms a conducting path with the first conductive terminal 206 and the second conductive terminal 207.

More than one lamp system 20 may be connected in series to form a series-connected light source. When the bulb assembly 200 in any lamp system 20 in the series-connected light source is damaged, the shunt sheet metal socket assembly 210 is restored to the original position to form a conducting path as long as the damaged bulb assembly 200 is removed from the socket assembly 204. At this point, the first conductive terminal 206 and the second conductive terminal 207 contact the two ends of the shunt sheet metal 211, respectively, such that the whole series-connected light source still may form a conducting path. However, when the lamp system 20 is being manufactured, the positions of the conductive terminals 206 and 207 should be changed, and the shunt sheet metal socket assembly 210 is disposed within the socket assembly 204. Therefore, the manufacturing flow of the lamp system 20 is more complicated than the manufacturing flow of a conventional lamp system, thereby enhancing the cost.

Referring to FIG. 5, a lamp system disclosed in US Patent Publication No. 20060274556 is shown. The lamp system 30 includes a bulb assembly 300 and a socket assembly 304. The bulb assembly 30 includes a first bulb pin 301, a second bulb pin 302, and an insulation object 303 disposed on the bottom thereof. The socket assembly 304 includes an outer housing 305, a first conductive terminal 306, a second conductive terminal 307, and an elastic sheet metal base assembly 310. The outer housing 305 includes an opening 305A to install the bulb assembly 300. The outer housing 305 further includes a first wire opening 306A and a second wire opening 307A, so as to connect the conductive terminals 306, 307 with external wires 308, 309. The first conductive terminal 306 is externally connected to the first wire 308, and the second conductive terminal 307 is externally connected to the second wire 209. The elastic sheet metal base assembly 310 is one part of the socket assembly 304, and the elastic sheet metal base assembly 310 includes an elastic sheet metal 311. When the bulb assembly 300 is not installed on the socket assembly 304, the first conductive terminal 306 contacts a first end 311A of the elastic sheet metal 311, and the second conductive terminal 307 contacts a second end 311B of the elastic sheet metal 311, such that a conducting path is formed between the first conductive terminal 306, the second conductive terminal 307, and the elastic sheet metal 311.

Referring to FIG. 6, a schematic view of installing the bulb assembly 300 in FIG. 5 on the socket assembly 304 is shown. When the bulb assembly 300 is installed on the socket assembly 304, the insulation object 303 insulates the conductive terminals 306 and 307 from the elastic sheet metal 311. That is to say, the first conductive terminal 306 and the second conductive terminal 307 will not contact the two ends 311A and 311B of the elastic sheet metal 311. At this point, the first bulb pin 301 contacts the first conductive terminal 306, and the second bulb pin 302 contacts the second conductive terminal 307. The bulb assembly 300 forms a conducting path with the first conductive terminal 306 and the second conductive terminal 307.

More than one lamp system 30 may be connected in series to form a series-connected light source. When the bulb assembly 300 in any lamp system 30 in the series-connected light source is damaged, the elastic sheet metal 311 is restored to the original position to form a conductive path as long as the damaged bulb assembly 300 is removed from the socket assembly 304, such that the first conductive terminal 306 and the second conductive terminal 307 contact the two ends 311A and 311B of the elastic sheet metal 311, respectively, and the whole series-connected light source may still form a conducting path. However, when the lamp system 30 is being manufactured, the positions of the conductive terminals 306 and 307 should be changed, and the elastic sheet metal base assembly 310 is one part of the socket assembly 304. Therefore, the manufacturing flow of the lamp system 30 is more complicated than the manufacturing flow of a conventional lamp system, thereby enhancing the cost.

In view of the above, with regard to the conventional lamp systems in a series-connected light source, the positions of the conductive terminals must be changed in the manufacturing flow, thereby causing an enhanced manufacturing cost. In order to solve the aforementioned and other problems, the present invention provides a lamp system in a series-connected light source manufactured with a low cost, in which the positions of the conductive terminals need not be changed in the manufacturing flow.

SUMMARY OF THE INVENTION

The present invention provides a lamp system manufactured with a low cost, in which positions of conductive terminals need not be changed in manufacturing flow. The specifications of a bulb assembly and a socket assembly are the same as the specifications of the conventional bulb assembly and socket assembly. The lamp system is more applicable to a series-connected light source.

As embodied and broadly described herein, the present invention provides a lamp system including a bulb assembly, a socket assembly, and a conductor base assembly. The bulb assembly includes an insulation object, a first bulb pin, and a second bulb pin. The insulation object is disposed on the bottom of the bulb assembly. The socket assembly includes an outer housing, a first conductive terminal, and a second conductive terminal. The outer housing includes an opening to install the bulb assembly. The conductor base assembly includes a conductor and the conductor base assembly is an element manufactured independently and should be placed in the socket assembly. When the bulb assembly is not installed on the socket assembly, one end of the conductor contacts the first conductive terminal, and the other end of the conductor contacts the second conductive terminal, thereby forming a conducting path between the conductor, the first conductive terminal, and the second conductive terminal. When the bulb assembly is installed on the socket assembly, the insulation object on the bottom of the bulb assembly insulates the conductor from the conductive terminals, the first bulb pin contacts the first conductive terminal, and the second bulb pin contacts the second conductive terminal, thereby forming a conducting path between the bulb assembly, the first conductive terminal, and the second conductive terminal.

More than one lamp system may be connected in series to form a series-connected light source. When one bulb assembly in any lamp system in the series-connected light source is damaged, the whole series-connected light source still forms a conducting path as long as the damaged bulb assembly is removed from the socket assembly of the lamp system.

Since the lamp system provided by the present invention is installed on the conductor base assembly, when one bulb assembly in any lamp system in the series-connected light source is damaged, the series-connected light source still maintains a conducting path as long as the bulb assembly is removed. The conductor base assembly is an element manufactured independently. Therefore, the positions of the conductive terminals need not be changed during the manufacturing flow and the manufacturing cost is low. The specifications of the bulb assembly and the socket assembly are the same as the specifications of the conventional bulb assembly and socket assembly.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
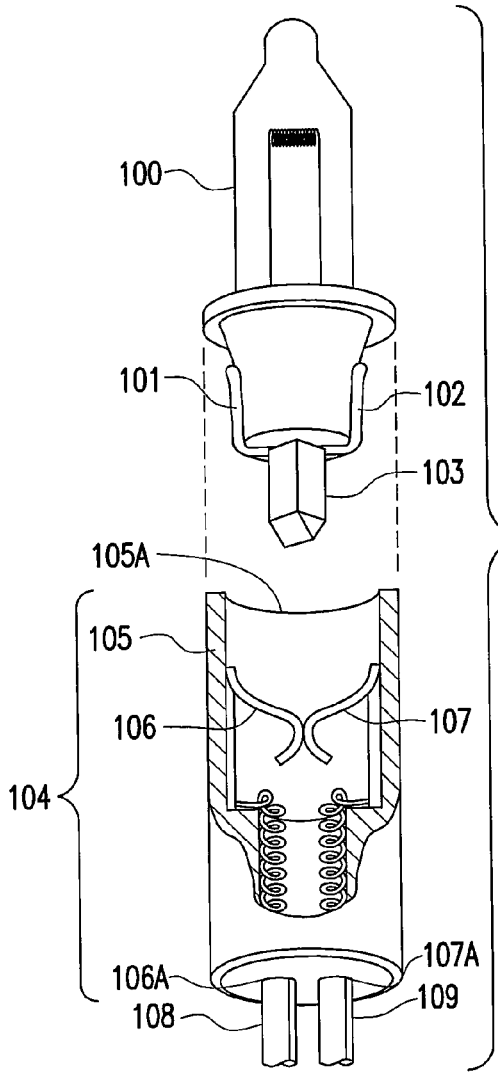
FIG. 1 (PRIOR ART) FIG. 2 (PRIOR ART)
FIG. 1 is a lamp system disclosed in U.S. Pat. No. 6,257,740.
Figure 2:
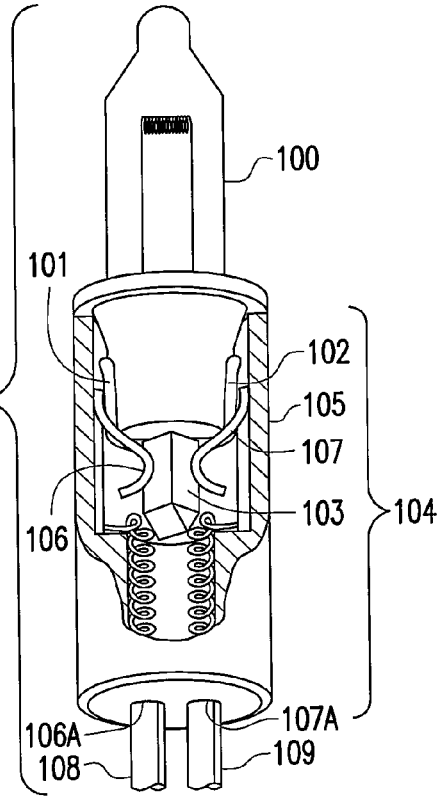
FIG. 1 (PRIOR ART) FIG. 2 (PRIOR ART)
FIG. 2 is a schematic view of installing the bulb assembly 100 in FIG. 1 on the socket assembly 104.
Figure 3:
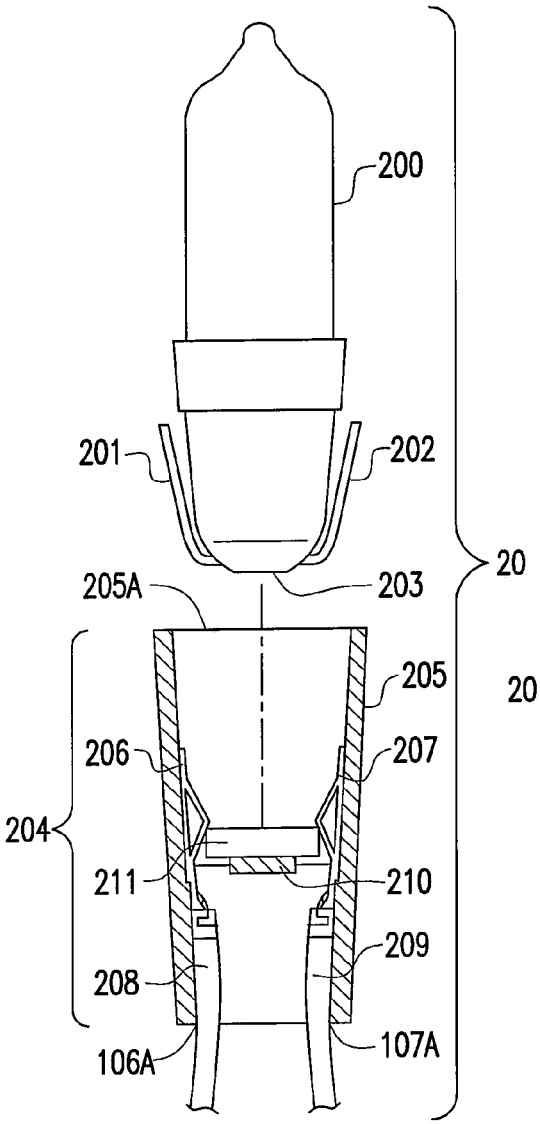
FIG. 3 (PRIOR ART) FIG. 4 (PRIOR ART)
FIG. 3 is a lamp system disclosed in U.S. Pat. No. 6,805,463.
Figure 4:
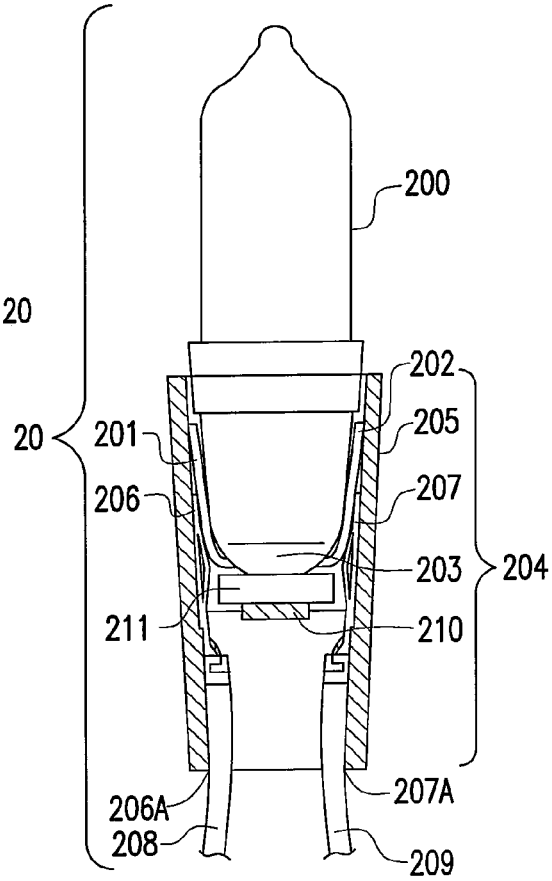
FIG. 3 (PRIOR ART) FIG. 4 (PRIOR ART)
FIG. 4 is a schematic view of installing the bulb assembly 200 in FIG. 3 on the socket assembly 204.
Figure 5:
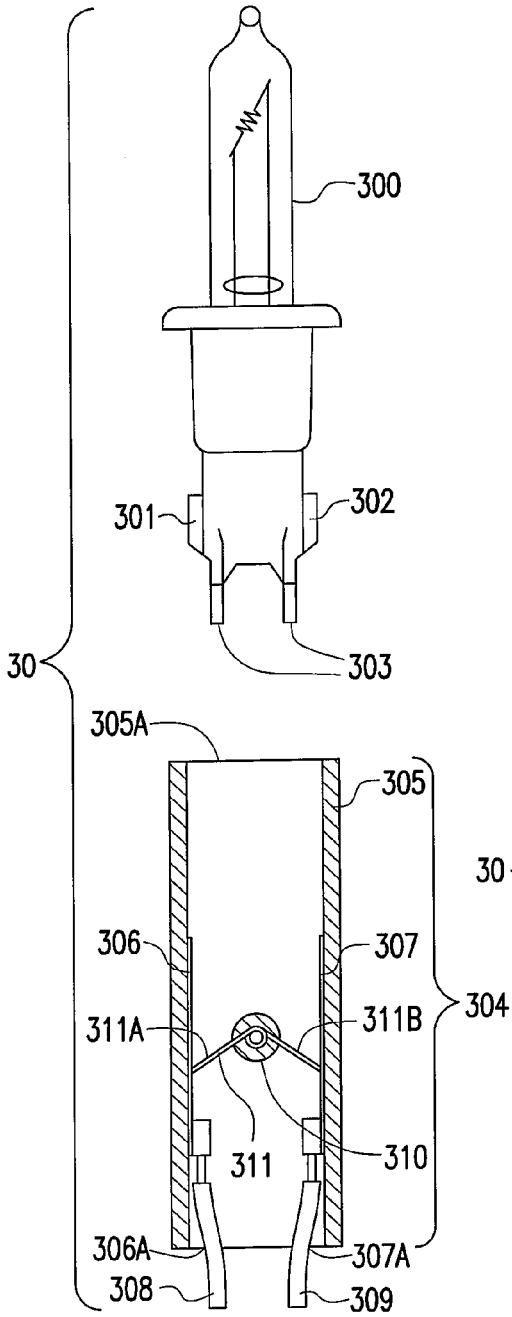
FIG. 5 (PRIOR ART) FIG. 6 (PRIOR ART)
FIG. 5 is a lamp system disclosed in US Patent Publication No. 20060274556.
Figure 6:
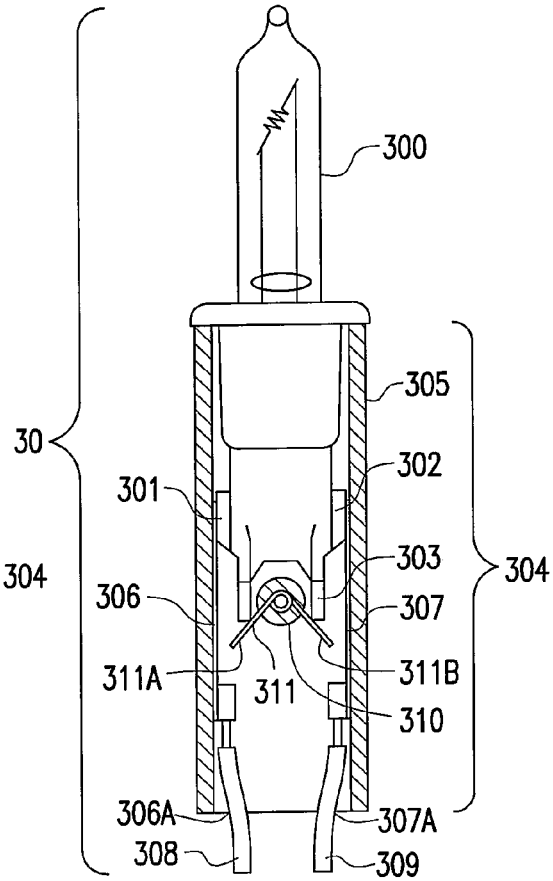
FIG. 5 (PRIOR ART) FIG. 6 (PRIOR ART)
FIG. 6 is a schematic view of installing the bulb assembly 300 in FIG. 5 on the socket assembly 304.
Figure 7:
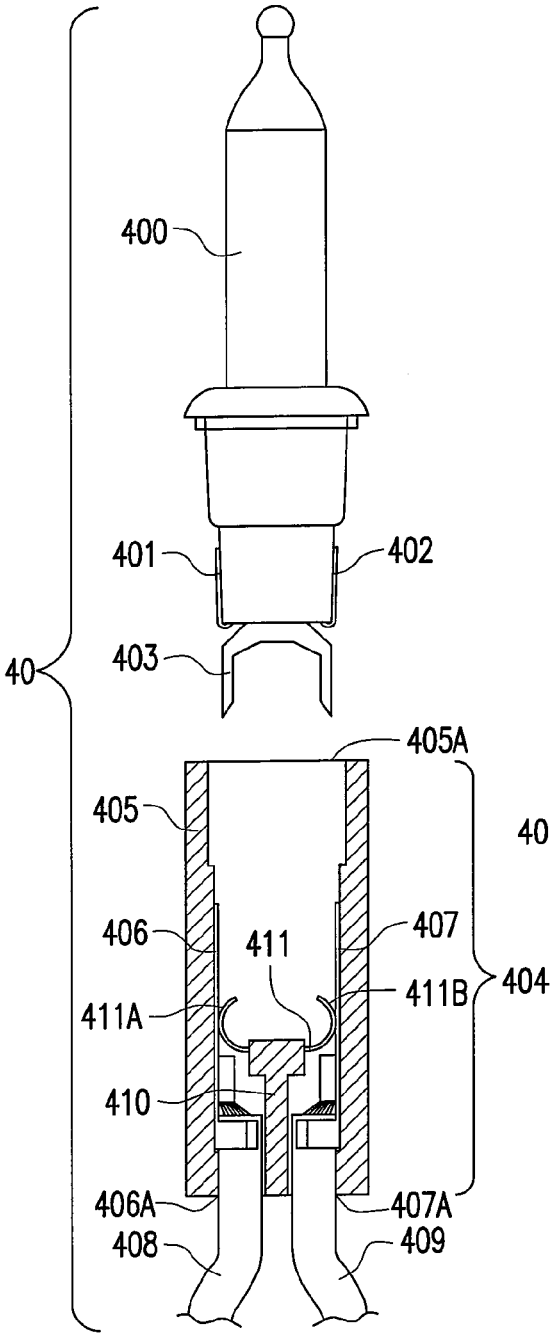
FIG. 7 is a lamp system according to an embodiment of the present invention.

Referring to FIG. 7, a lamp system according to an embodiment of the present invention is shown. The lamp system 40 includes a bulb assembly 400, a socket assembly 404, and a conductor base assembly 410. The bulb assembly 40 includes a first bulb pin 401, a second bulb pin 402, and an insulation object 403 on the bottom thereof. The socket assembly 404 includes an outer housing 405, a first conductive terminal 406, and a second conductive terminal 407. The outer housing 405 includes an opening 405A to install the bulb assembly 400. The outer housing 405 further includes a first wire opening 406A and a second wire opening 407A, so as to connect the conductive terminals 406, 407 with external wires 408, 409. The first conductive terminal 406 is externally connected to the first wire 408, and the second conductive terminal 407 is externally connected to the second wire 409. The conductor base assembly 410 includes a conductor 411. The conductor base assembly 410 is directly placed in the socket assembly 404. When the bulb assembly 400 is not installed on the socket assembly 404, the first conductive terminal 406 and the second conductive terminal 407 contact two ends 411A and 411B of the conductor 411, respectively, so as to form a conducting path between the first conductive terminal 406, the second conductive terminal 407, and the conductor 411.

Figure 8:
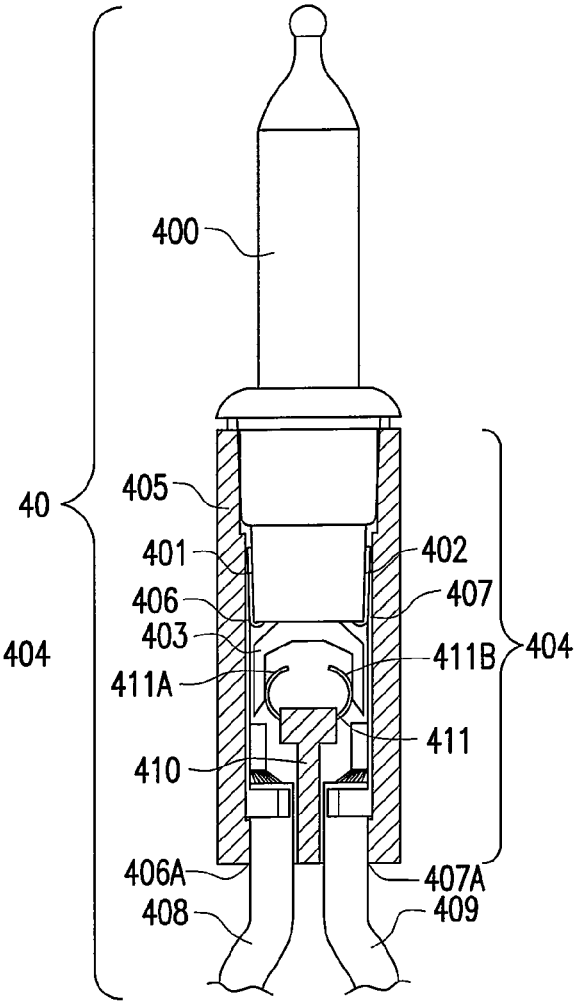
FIG. 8 is a schematic view of installing the bulb assembly 400 in FIG. 7 on the socket assembly 404.

Referring to FIG. 8, a schematic view of installing the bulb assembly 400 in FIG. 7 on the socket assembly 404 is shown. When the bulb assembly 400 is installed on the socket assembly 404, the insulation object 403 insulates the conductor 411 from the conductive terminals 406 and 407. That is, the first conductive terminal 406 and the second conductive terminal 407 will not contact the two ends 411A and 411B of the conductor 411. At this point, the first bulb pin 401 contacts the first conductive terminal 406, and the second bulb pin 402 contacts the second conductive terminal 407. The bulb assembly 400 forms a conducting path with the first conductive terminal 406 and the second conductive terminal 407.

More than one lamp system 40 may be connected in series to form a series-connected light source. When one bulb assembly 400 in any lamp system 40 in the series-connected light source is damaged, the two ends 411A and 411B of the conductor 411 will be restored to the original positions to form a conducting path as long as the damaged bulb assembly 400 is removed from the socket assembly 404. The first conductive terminal 406 and the second conductive terminal 407 contact the two ends 411A and 411B of the conductor 411, respectively, such that the whole series-connected light source still forms a conducting path.

The conductor base assembly 410 is an element manufactured independently, and the bulb assembly 400 and the socket assembly 404 are in a conventional lamp system. The conductor base assembly 410 may be directly placed in the socket assembly 404. In other words, the conductor base assembly 410 is not a part of the socket assembly 404. The sheet metal socket assembly 410 may be directly placed in the conventional lamp system, such that the conventional lamp system may be changed into a lamp system applicable to the series-connected light source. Therefore, during a manufacturing flow, the positions of the conductive terminals 406 and 407 in the socket assembly 404 need not be changed. In addition, the conductive terminals 406 and 407 may be copper sheet metals. The socket assembly 404 is a socket assembly 404 made of a plastic material.

Figure 9:
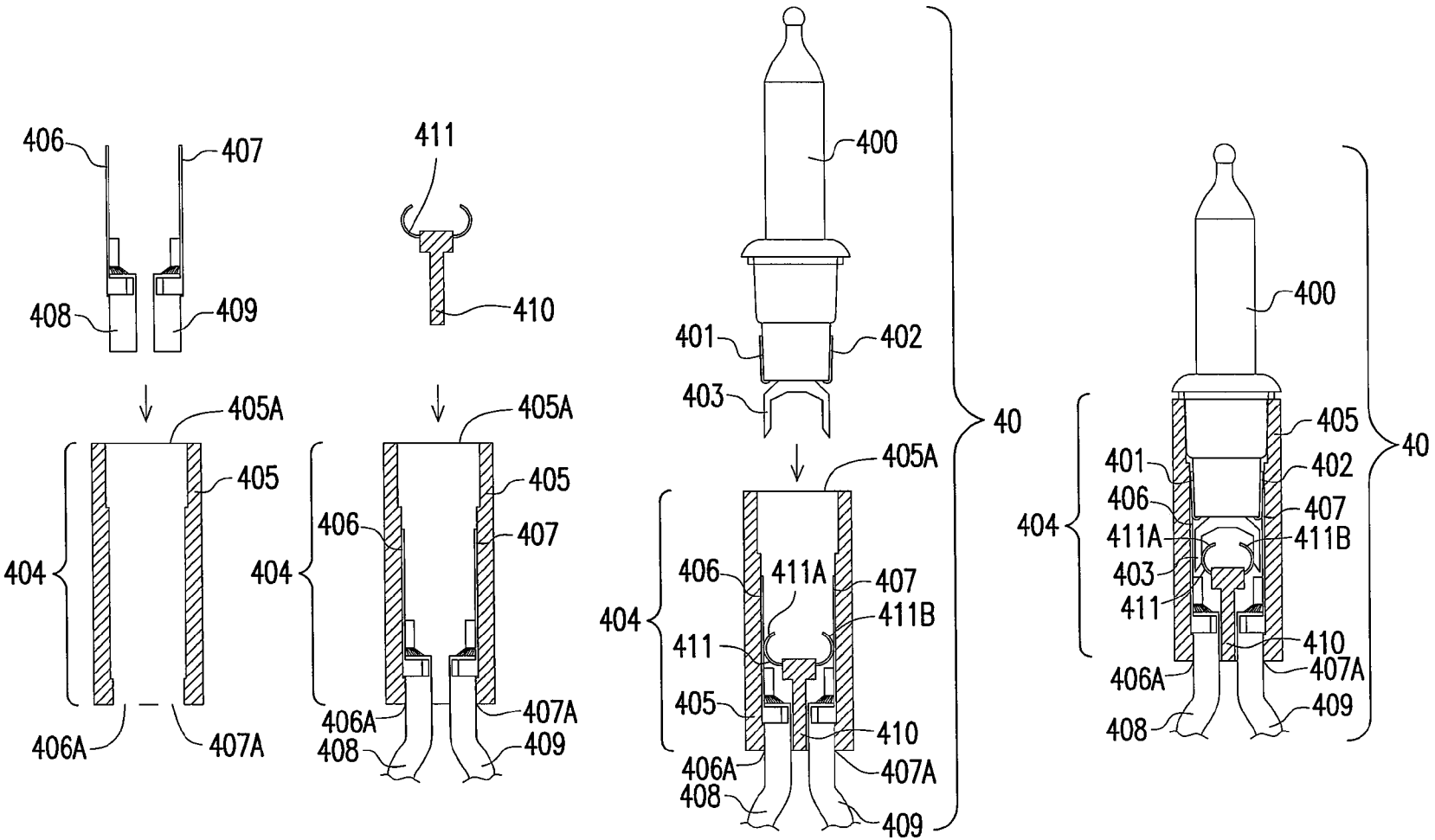
FIG. 9 is a schematic installation view of the lamp system 40 according to an embodiment of the present invention.

Then, referring to FIG. 9, a schematic installation view of the lamp system 40 according to an embodiment of the present invention is shown. Firstly, the conductive terminals 406 and 407 are connected to the wires 408 and 409 and placed in an inner chamber of the conventional socket assembly 404. Secondary, the sheet metal socket assembly 410 manufactured independently is placed in the conventional socket assembly 404. Finally, the bulb assembly 400 is installed on the socket assembly 404.

Figure 10:
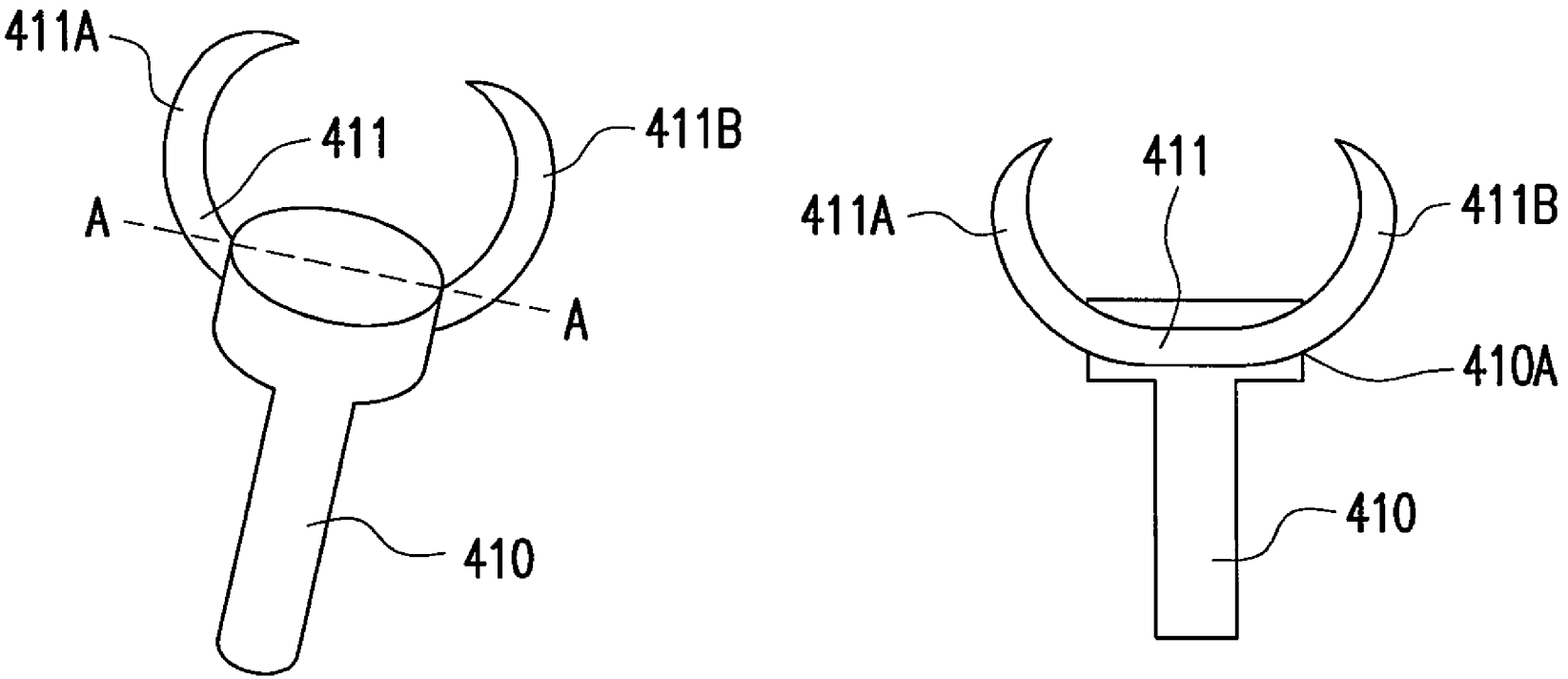
FIG. 10 is a sectional view of the conductor base assembly 410 along Line A-A.

Finally, referring to FIG. 10, a sectional view of the conductor base assembly 410 along Line A-A is shown. The conductor base assembly 410 includes a hollow groove 410A for accommodating the conductor 411. The conductor base assembly 410 may be a base assembly made of a plastic material. The conductor 411 may be a ceratoid elastic sheet metal. Referring to FIG. 8, the insulation object 403 may be a ⊓-shaped insulation fork, so as to prevent the ceratoid elastic sheet metal (the conductor 411) from contacting the conductive terminals 406, 407.

In view of the above, since the lamp system in the present invention employs a sheet metal base assembly manufactured independently, when one bulb assembly in any lamp system in the series-connected light source is damaged, the two ends of the conductor of the conductor base assembly will contact the conductive terminals of the socket assembly as long as the damaged bulb assembly is removed from the socket assembly of the lamp system, such that the series-connected light source still maintains a conducting path. The conductor base assembly is an element manufactured independently. Therefore, the positions of the conductive terminals need not be changed during the manufacturing flow and the manufacturing cost is low. Furthermore, the specifications of the bulb assembly and the socket assembly are the same as the specifications of the conventional bulb assembly and socket assembly.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A lamp system, comprising:

a bulb assembly, comprising:

an insulation object, disposed on the bottom of the bulb assembly;

a first bulb pin, providing a conducting path of the bulb assembly; and a second bulb pin, providing a conducting path of the bulb assembly;

a socket assembly, for installing the bulb assembly, comprising:

an outer housing, having an opening to install the bulb assembly;

a first conductive terminal; and a second conductive terminal; and a conductor base assembly, having a conductor, wherein the conductor base assembly is an element manufactured independently and is placed in the socket assembly, the conductor base assembly is a base assembly made of a plastic material, the conductor base assembly comprises a hollow groove for accommodating the conductor, and the conductor is a ceratoid elastic sheet metal, wherein, when the bulb assembly is not installed on the socket assembly, one end of the conductor contacts the first conductive terminal, and the other end of the conductor contacts the second conductive terminal, thereby forming a conducting path between the conductor, the first conductive terminal, and the second conductive terminal, when the bulb assembly is installed on the socket assembly, the insulation object on the bottom of the bulb assembly insulates the conductor from the first conductive terminal and the second conductive terminal, the first bulb pin contacts the first conductive terminal, and the second bulb pin contacts the second conductive terminal, thereby forming a conducting path between the bulb assembly, the first conductive terminal, and the second conductive terminal.

2. A lamp system used in a series-connected light source, comprising:

a bulb assembly, having an insulation object, a first bulb pin, and a second bulb pin;

a socket assembly, having an outer housing with an opening to install the bulb assembly, wherein the socket assembly comprises a first conductive terminal and a second conductive terminal therein; and a conductor base assembly, wherein the conductor base assembly comprises a conductor, and the conductor base assembly is an element manufactured independently and is placed in the socket assembly, the conductor base assembly is a base assembly made of a plastic material, the conductor base assembly comprises a hollow groove for accommodating the conductor, and the conductor is a ceratoid elastic sheet metal, and when the bulb assembly is not installed on the socket assembly, one end of the conductor contacts the first conductive terminal, the other end of the conductor contacts the second conductive terminal, thereby forming a conducting path between the conductor, the first conductive terminal, and the second conductive terminal, and when the bulb assembly is installed on the socket assembly, the insulation object on the bulb assembly prevents the conductor from contacting the first conductive terminal and the second conductive terminal, the first bulb pin contacts the first conductive terminal, and the second bulb pin contacts the second conductive terminal, thereby forming a conducting path between the bulb assembly, the first conductive terminal, and the second conductive terminal.

3. The lamp system as claimed in claim 1, wherein the insulation object is a ⊓-shaped insulation fork for preventing the ceratoid elastic sheet metal from contacting the first conductive terminal and the second conductive terminal.

4. The lamp system as claimed in claim 1, wherein the socket assembly is a plastic socket assembly, the socket assembly comprises a first wire opening and a second wire opening on the bottom thereof, so as to connect the first conductive terminal and the second conductive terminal with external wires, thereby forming a conducting path between the first conductive terminal, the second conductive terminal and the external wires.

5. The lamp system as claimed in claim 1, wherein the lamp systems are connected in series to form a series-connected light source, and when a bulb system in any lamp system in the series-connected light source is damaged, the whole series-connected light source still forms a conducting path as long as the damaged bulb assembly is removed from the socket assembly of the lamp system.

6. The lamp system as claimed in claim 1, wherein the specifications of the bulb assembly and the socket assembly are the same as the specifications of the conventional bulb assembly and socket assembly.

7. The lamp system claimed in claim 2, wherein the lamp systems are connected in series to form a series-connected light source, and when a bulb system in any lamp system in the series-connected light source is damaged, the whole series-connected light source still forms a conducting path as long as the damaged bulb assembly is removed from the socket assembly of the lamp system.

8. The lamp system claimed in claim 2, wherein the specifications of the bulb assembly and the socket assembly are the same as the specifications of the conventional bulb assembly and socket assembly.

9. The lamp system claimed in claim 2, wherein the insulation object is a ⊓-shaped insulation fork for preventing the ceratoid elastic sheet metal from contacting the first conductive terminal and the second conductive terminal.

10. The lamp system claimed in claim 2, wherein the socket assembly is a plastic socket assembly, the socket assembly comprises a first wire opening and a second wire opening on the bottom thereof, so as to connect the first conductive terminal and the second conductive terminal with external wires, thereby forming a conducting path between the first conductive terminal, the second conductive terminal and the external wires.

* * * * *